US009376999B2

(12) United States Patent
Sloan, Jr.

(10) Patent No.: US 9,376,999 B2
(45) Date of Patent: Jun. 28, 2016

(54) ENGINE STARTER INERTIA DRIVE

(71) Applicant: Paul H. Sloan, Jr., Portage, MI (US)

(72) Inventor: Paul H. Sloan, Jr., Portage, MI (US)

( * ) Notice: Subject to any disclaimer, the term of this patent is extended or adjusted under 35 U.S.C. 154(b) by 228 days.

(21) Appl. No.: 13/973,790

(22) Filed: Aug. 22, 2013

(65) Prior Publication Data

US 2015/0053047 A1 Feb. 26, 2015

(51) Int. Cl.

*F02N 11/00* (2006.01)
*F02N 15/06* (2006.01)
*F02N 15/02* (2006.01)

(52) U.S. Cl.

CPC ..... *F02N 15/06* (2013.01); *F02N 15/025* (2013.01); *F02N 2015/061* (2013.01); *Y10T 74/134* (2015.01)

(58) Field of Classification Search

CPC ..... F02N 11/00; F02N 15/06; F02N 15/025; F02N 2015/061; Y10T 74/13; Y10T 74/134
See application file for complete search history.

(56) References Cited

U.S. PATENT DOCUMENTS 2,933,926 A * 4/1960 Buxton et al. ..... F02N 15/062 464/47
2,996,924 A * 8/1961 Sabatini ..... F02N 15/065 74/7 R
3,222,938 A * 12/1965 Digby ..... F02N 15/065 74/7 R
3,686,961 A * 8/1972 Campbell ..... F02N 15/006 74/7 R
3,851,532 A * 12/1974 Pfluger ..... F02N 15/025 192/104 R
4,395,923 A * 8/1983 Giometti ..... F02N 15/065 192/114 R
4,712,435 A * 12/1987 Losey ..... F02N 15/026 192/103 A
4,715,239 A * 12/1987 Giometti ..... F02N 15/026 192/103 A
4,744,258 A * 5/1988 Volino ..... F02N 15/065 192/42
4,777,836 A * 10/1988 Giometti ..... F02N 15/026 192/103 A
4,843,897 A * 7/1989 Tallis, Jr. ..... F02N 15/026 192/103 A
5,042,312 A * 8/1991 Giometti ..... F02N 15/063 74/6
5,111,706 A * 5/1992 McMillen ..... F02B 61/045 403/326

(Continued)

*Primary Examiner* — David M Fenstermacher
(74) *Attorney, Agent, or Firm* — R. Tracy Crump

(57) ABSTRACT

The inertia drive consists of a clutch subassembly including an input head shaft, a clutch plate stack, six clutch springs, and a clutch housing; and a screw shaft/pinion subassembly including a screw shaft, a pinion and a stop nut. Spline engagements and snap rings are used to couple the clutch housing and stop nut to the screw shaft. The use of splined engagements and snap rings eliminates the need for stop nuts to be threaded onto the screw shaft, reducing manufacturing cost and increasing durability. The use of splined engagements for coupling the screw shaft to the clutch housing and the stop nut to the screw shaft also allows both the clutch housing and stop nuts to be radially positioned on the screw shaft with incremental adjustability to selectively orientate the pinion relative to both the clutch housing and the stop nut.

28 Claims, 13 Drawing Sheets

(56) References Cited

U.S. PATENT DOCUMENTS 5,513,540 A * 5/1996 Giometti ..... F02N 15/063 74/6
5,596,902 A * 1/1997 McMillen ..... F02N 15/063 464/46
5,894,756 A * 4/1999 Uehara ..... F02N 15/065 192/114 R
6,109,122 A * 8/2000 Bori ..... F02N 15/046 188/82.2
6,935,202 B2 * 8/2005 Siems ..... F02N 15/066 123/179.28
6,948,392 B2 9/2005 Eckard et al.
6,993,989 B2 * 2/2006 Oomura ..... F02N 15/046 123/182.1
6,997,072 B2 * 2/2006 Saito ..... F02N 15/046 123/179.25
7,296,489 B2 * 11/2007 Oomura ..... F02N 15/046 74/6
8,596,155 B2 * 12/2013 Mullins, III ..... F02N 15/025 74/6
9,004,035 B2 * 4/2015 Chu ..... F02N 15/063 123/179.25
2002/0157489 A1 * 10/2002 Murata ..... F02N 15/06 74/6
2003/0200826 A1 * 10/2003 Oomura ..... F02N 15/046 74/7 E
2004/0211273 A1 * 10/2004 Okumoto ..... F02N 15/065 74/7 R
2011/0308341 A1 * 12/2011 Mullins, III ..... F02N 15/025 74/89.38

* cited by examiner

ENGINE STARTER INERTIA DRIVE

This invention relates generally to engine starters, and particularly inertia drives for engine starters.

BACKGROUND OF THE INVENTION

Heavy industrial equipment is often powered by larger displacement combustion engines ranging between 5 L (305 c.i.d.) and 300 L (18,300 c.i.d.) or more. Large displacement combustion engines generally require the use of engine starters coupled to the engine by a starter drive assembly to start. Starter drive assemblies use an inertia drive mechanism ("inertia drive') to transfer rotation from the starter motor's output shaft to the flywheel of the combustion engine for initial engine startup.

Typically, the inertia drive includes a clutch plate stack coupled to the output shaft of the starter motor and a screw shaft on which a pinion gear rides. The clutch plate stack is pressed together by a number of coiled pressure springs. During engine startup, the turbine air motor driven from the source of air/gas turns its output shaft. The inertia drive transfers the rotation of the starter motor's output shaft via the clutch plate stack to drive the screw shaft. The inertia of the pinion gear causes it to be translated along the screw shaft and into engagement with a ring gear of the engine. Once the pinion gear reaches the end of its travel along the screw shaft, it is fully meshed with the engine's ring gear. Continued rotation of the screw shaft rotates the pinion gear, which in turn rotates the ring gear of the engine to start the engine. Once the engine starts, it begins to accelerate the ring gear faster than the rotation of the screw shaft. This results in the pinion gear being translated along the screw shaft away from and out of engagement with the ring gear.

The basic design of inertia drives has remained unchanged since the 1960s. Heretofore, the design of inertia drives has required costly manufacturing methods in order to achieve the desired functionality. By way of example, the acme threads formed in the screw shaft and pinion must be precisely machined so that the contact surfaces of the clutch housing and pinion properly orient and align for driving engagement. Consequently, the acme threads must be formed using a thread grinder in order to ensure the proper tolerances and orientation between the components. Grinding the acme threads into the screw shaft is a more expensive and time consuming manufacturing method. In addition, wave springs and other components have been incorporated into the design, as well as reinforced in order to accommodate and control the extreme torques generated from increasing more powerful starter motors. Nevertheless, inertia drives are often damaged from the impact forces transmitted from the extreme torque loads instantly generated from conventional hydraulic starter motors.

SUMMARY OF INVENTION

The present invention provides improved inertia drives for a starter drive assembly that simplifies their design and manufacture while increasing their durability and functionality. The present invention reduce the number of drive components and replaces expensive highly machined components with less expensive, more durable components. As a result, the inertia drives embodying this invention provide a more versatile mechanism that can operate across a wide range of large displacement engines while reducing the overall cost of the drives.

In one embodiment, the inertia drive consists of a clutch subassembly including an input head shaft, a clutch plate stack, six clutch springs, and a clutch housing; and a screw shaft/pinion subassembly including a screw shaft, a pinion and a stop nut. The clutch housing is configured to operatively couple to the screw shaft as well as enclose the clutch stack and clutch springs. Contact nubs formed on the clutch housing, pinion and stop nut radially transfer the load without "face-to-face" contact between the pinion, clutch housing or stop nut. The input head shaft is fashioned from hexagon bar stock, which reduces manufacturing costs and provides a more positive engagement with the clutch stack. Spline engagements and snap rings are used to couple the clutch housing and stop nut to the screw shaft. The use of splined engagements and snap rings eliminates the need for stop nuts to be threaded onto the screw shaft, reducing manufacturing cost and increasing durability. The use of splined engagements for coupling the screw shaft to the clutch housing and the stop nut to the screw shaft also allows both the clutch housing and stop nuts to be radial positioned on the screw shaft with incremental adjustability to selectively orientate the pinion relative to both the clutch housing and the stop nut. The use of the splined engagement eliminates the need for the acme thread of the screw shaft to be precisely oriented and machined on the screw shaft. Consequently, the acme threads can be manufactured using less expensive manufacturing methods, such as roll forming.

In another embodiment, the inertia drive adds a set of L-shaped cantilevered bar springs that operatively engage the teeth of the pinion to provide an opposing force to the torque load on the pinion as it traverses between the "pre-start" position and the start position. The bar springs are fastened to the clutch housing and extend longitudinally over the pinion with a down-turned distal end adapted to seat between adjacent pinion teeth. The radially acting spring force provided by the bar springs on the pinion acts against the break out torque load of inertia drive. The bar springs can be used to selectively control the impact forces on the pinion for particular operational parameters. Bar springs can be readily swapped for other leaf springs with different spring tensions to selectively adjust the counterbalancing torque load.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
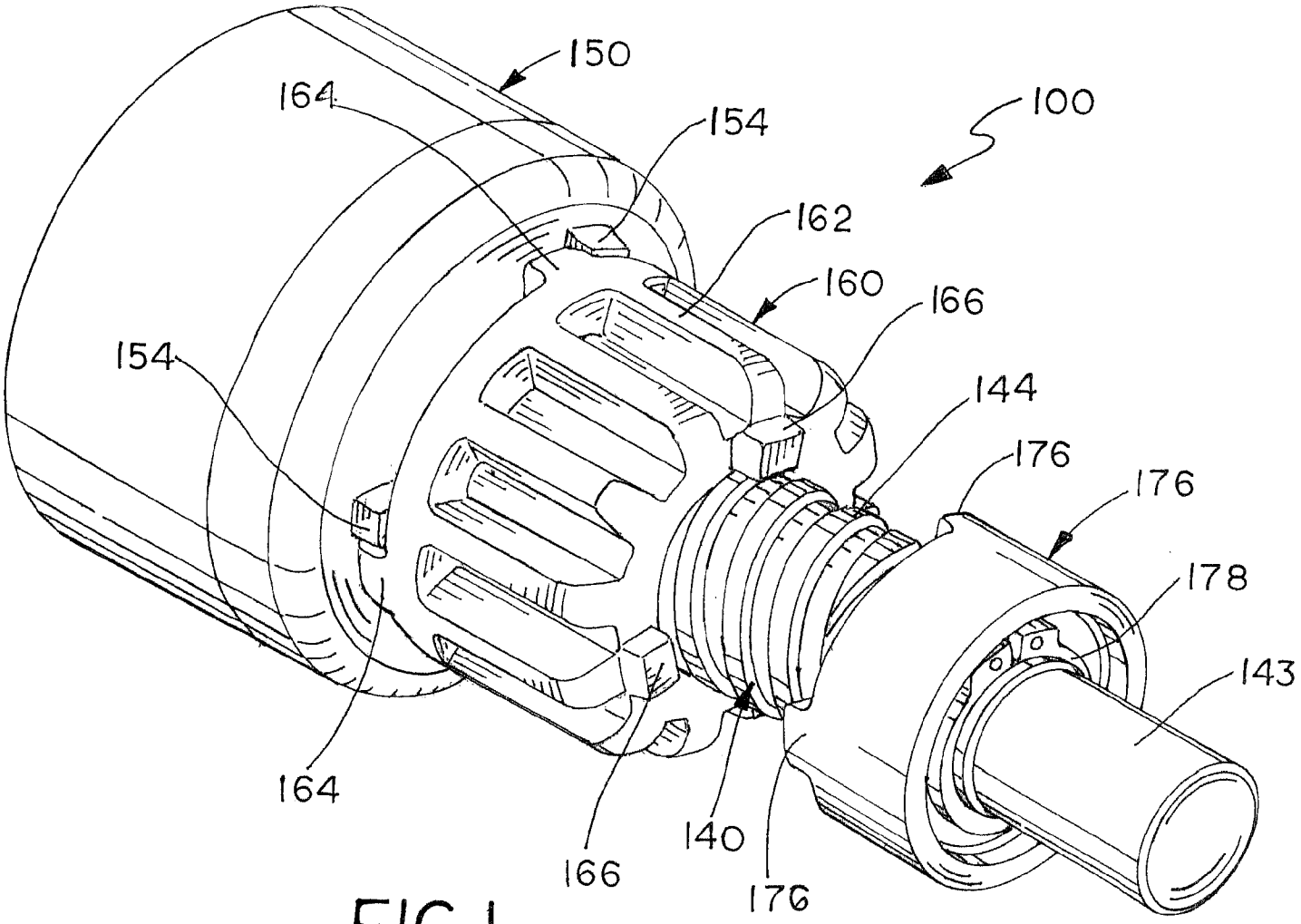
FIG. 1 is a perspective view of an embodiment of the inertia drive of this invention.
Figure 2:
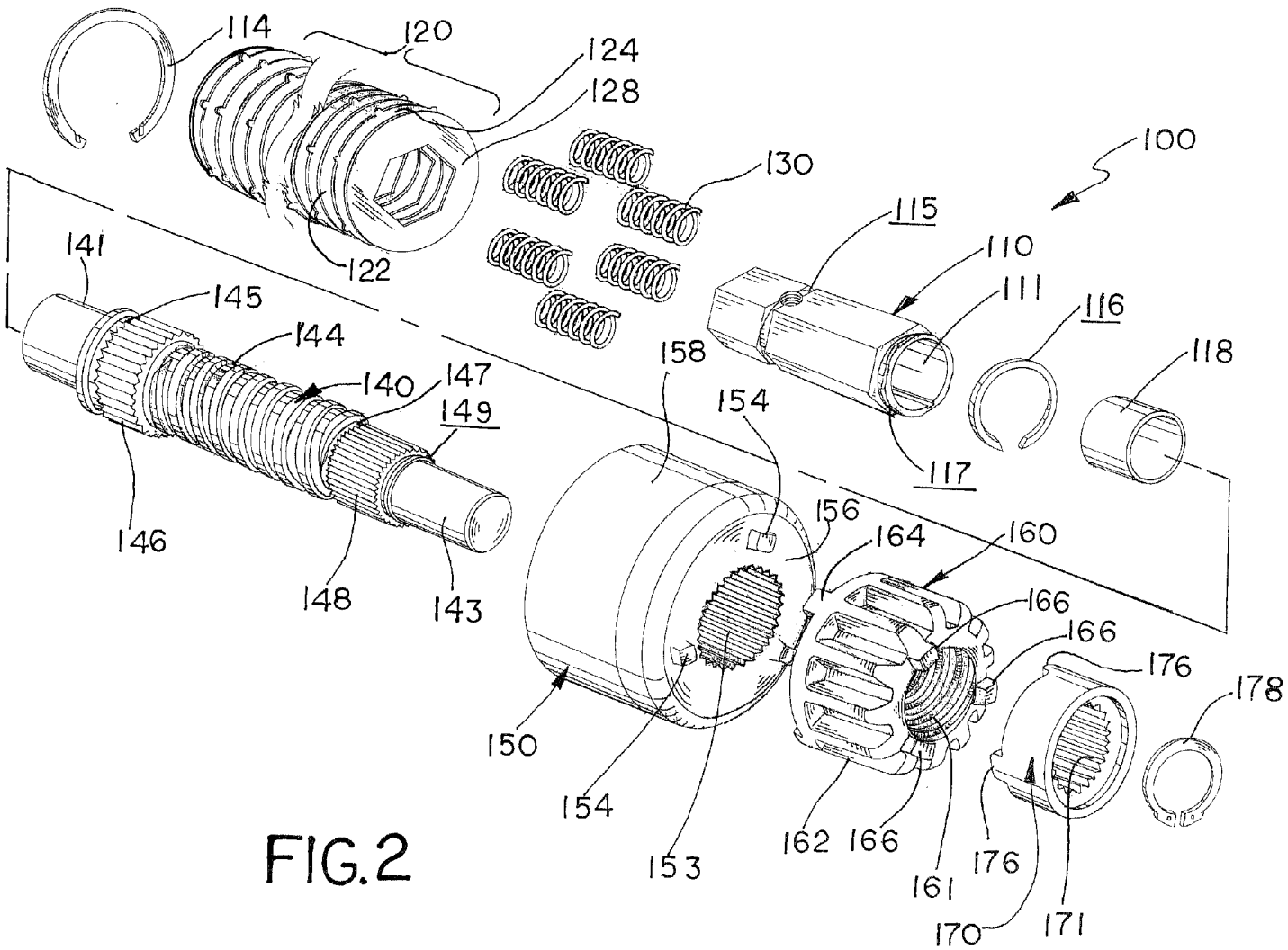
FIG. 2 is an exploded view of the inertia drive of FIG. 1.
Figure 3:
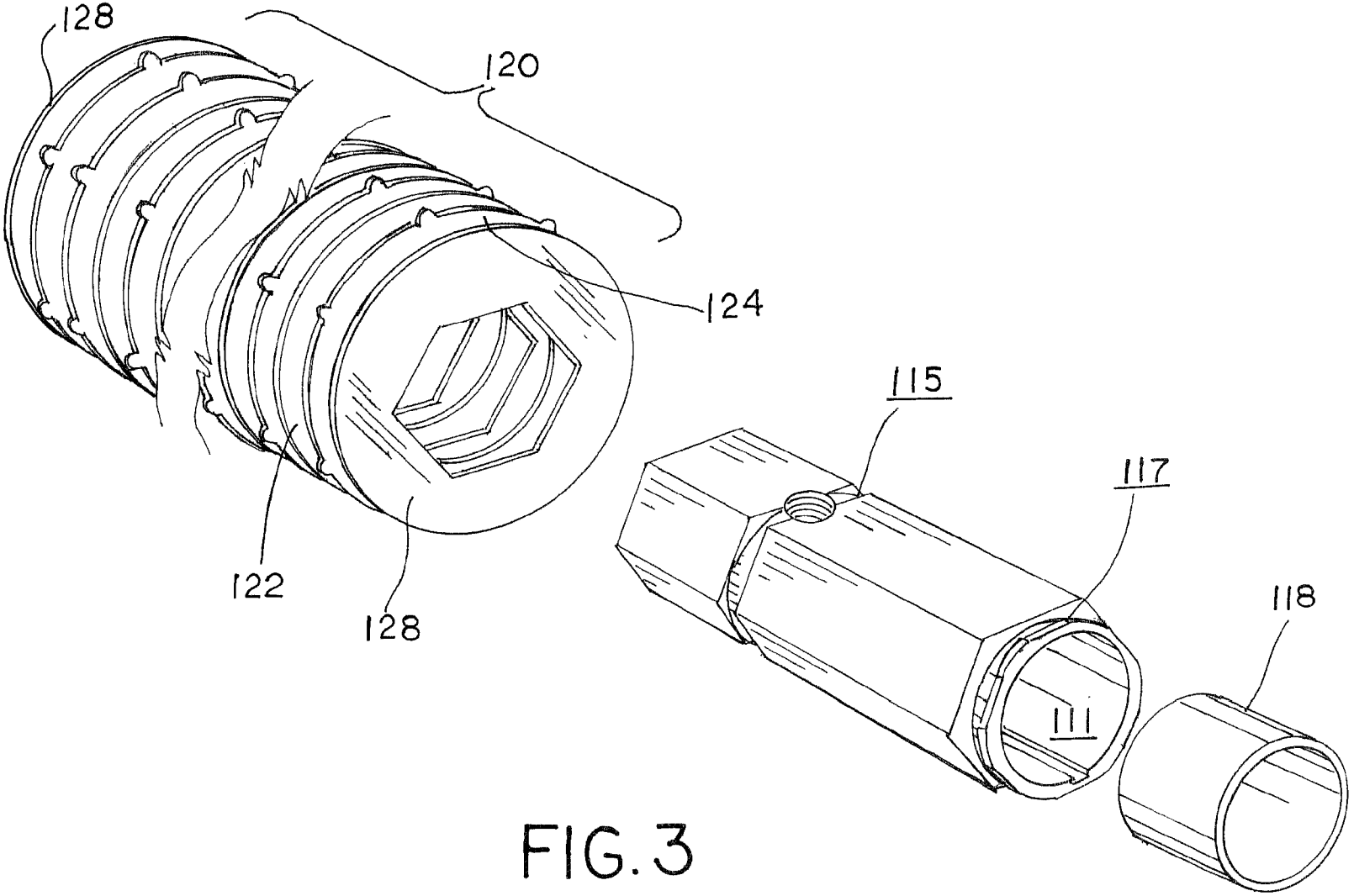
FIG. 3 is a partial exploded view of the clutch stack and the clutch input head used in the inertia drive of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The inertia drives embodying this invention are designed and intended for use in a starter drive assembly for transfer axial torque from a conventional starter motor (not shown) to initially turn the flywheel of a combustion engine (also not shown). The start drive assembly which the present invention are intended, as well as the start motors and combustion engines, are common and well known and readily understood in the art. As such the details of their structure and operation are not discussed in detail herein.

Referring now to the drawings, FIGS. 1-4 illustrate an embodiment of the inertia drive of this invention, which is designated generally as reference numeral 100. Inertia drive 100 generally consists of two subassemblies: a clutch subassembly and a screw shaft/pinion subassembly.

The clutch subassembly includes input head shaft 110, a clutch plate stack 120, six coil springs 130, and a clutch housing 150. Clutch stack 120 is positioned on input head shaft 110, along with backing plates 128 and covered by clutch housing 150. Clutch stack 120 is held within clutch housing 150 by a pair of snap rings 114 and 116. Snap ring 114 seats in an annular groove 159 formed on the inside of the sidewall 158. Snap ring 116 seats within an annular groove 117 formed in input head shaft 110.

Input head shaft 110 is machined from a suitable metal hexagonal bar stock. As shown, input head shaft 110 has a generally hexagonal cross section with six flat longitudinal sides and a cylinder axial bore 111. One end of input head shaft 110 is configured to connect to the drive shaft of the starter motor (not shown) and the opposite end is configured to receive screw shaft 140 and bushing 118.

Clutch housing 150 is an investment cast component and has a cup shaped body defined by a thick bottom wall 156 and integral cylindrical sidewall 158. A splined axial opening 153 is formed in the bottom wall 156 of the body. Three contact nubs 154 protrude from the outside bottom wall 156. Clutch springs 130 are seated within six axial bores 155 formed on the inside of the bottom wall 156 and spaced radially around splined opening 153. Clutch springs 130 bear against end plates 128 to provide a uniform compression force to clutch stack 120.

Clutch stack 120 consists of a plurality of clutch plates—input plate 122 and output plate 124. Input and output plates 122 and 124 are generally cut, stamped or otherwise formed from two dissimilar metals, such as copper or brass, and steel and stacked in an alternating arrangement one to another within the clutch stack 120. As readily understood in the art, friction between the adjacent clutch plates allows the transfer of the axial torque from the starter motor to the engine. In alternative embodiments, clutch plates may be formed from other composite metals, such as powder metals of various formulations as desired.

Figure 5:
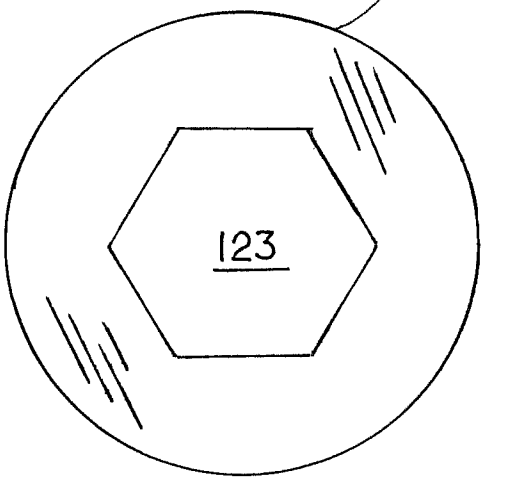
FIGS. 4 and 5 are side views of the output and input clutch plates used in the clutch stack of the inertia drive of FIG. 1.
Figure 4:
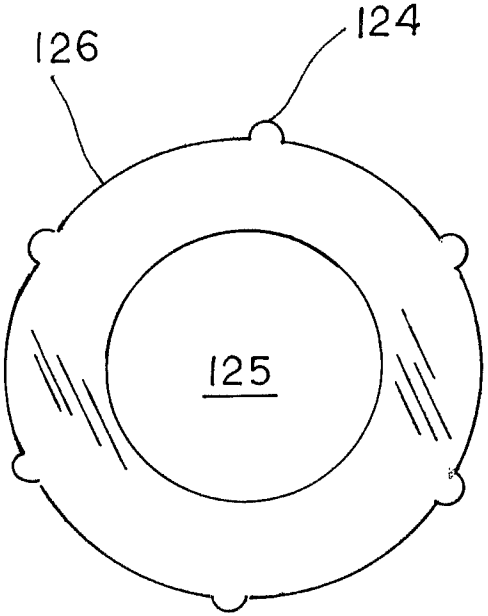

As shown in FIG. 5, input plate 122 has a hexagonal central opening 123 configured to operatively receive the hexagonal body of input head shaft 110. Similarly, FIG. 4 shows output plate 124 having a circular central opening 125 configured to receive input head shaft 110. Output plate 124 also has a plurality of protruding tabs 126, which are configured to seat within longitudinal channels 157 machined or formed on the inside of sidewall 128 of clutch housing 150. It should be noted that the mating hexagonal surface of input head shaft 110 and input plates 122 ensure that the input plates rotate with the input head shaft. Similarly, the engagement of tabs 126 seated within channels 157 ensures that clutch housing 150 turns with the rotation of output plates 124.

Figure 6:
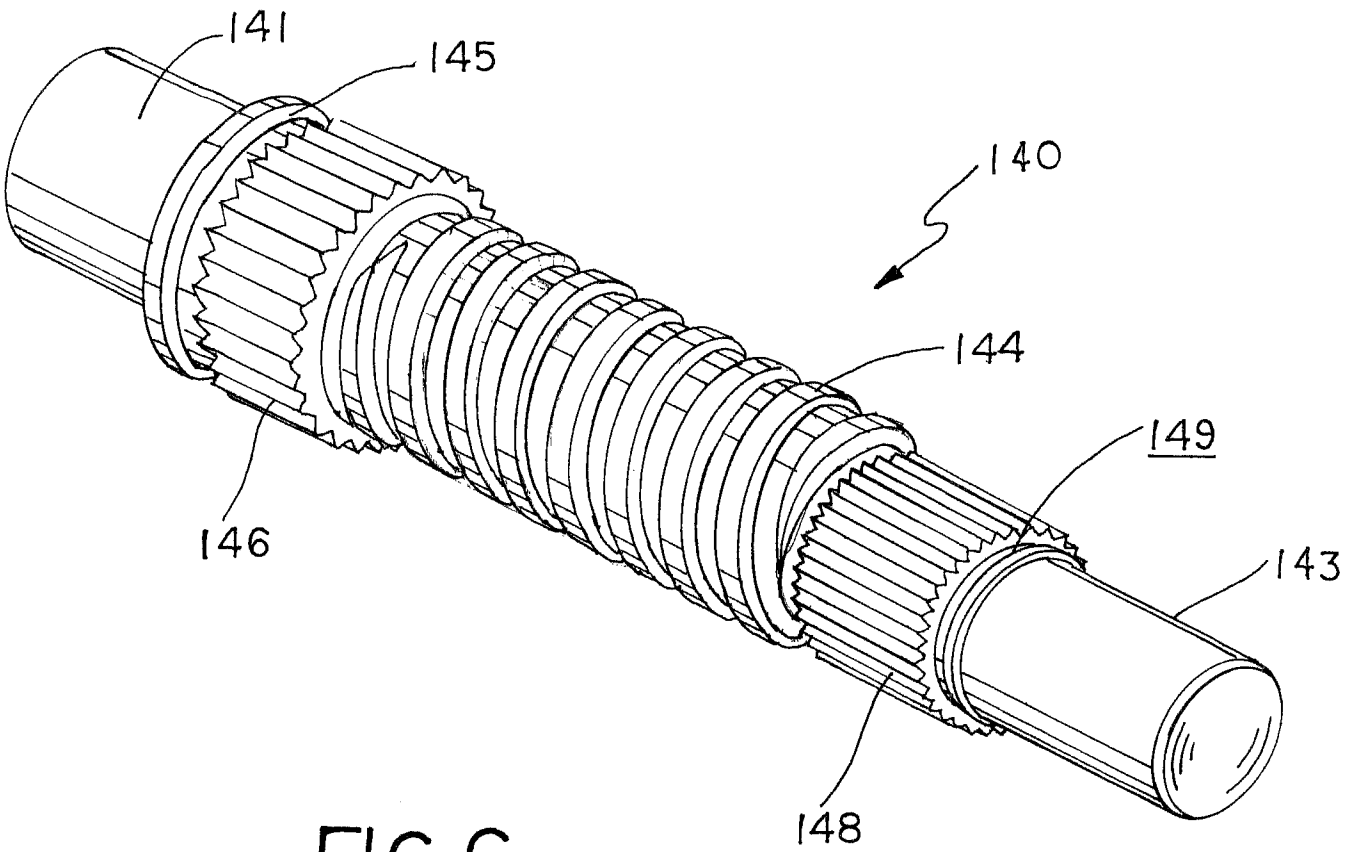
FIG. 6 is a perspective view of the screw shaft used in the inertia drive of FIG. 1.
Figure 7:
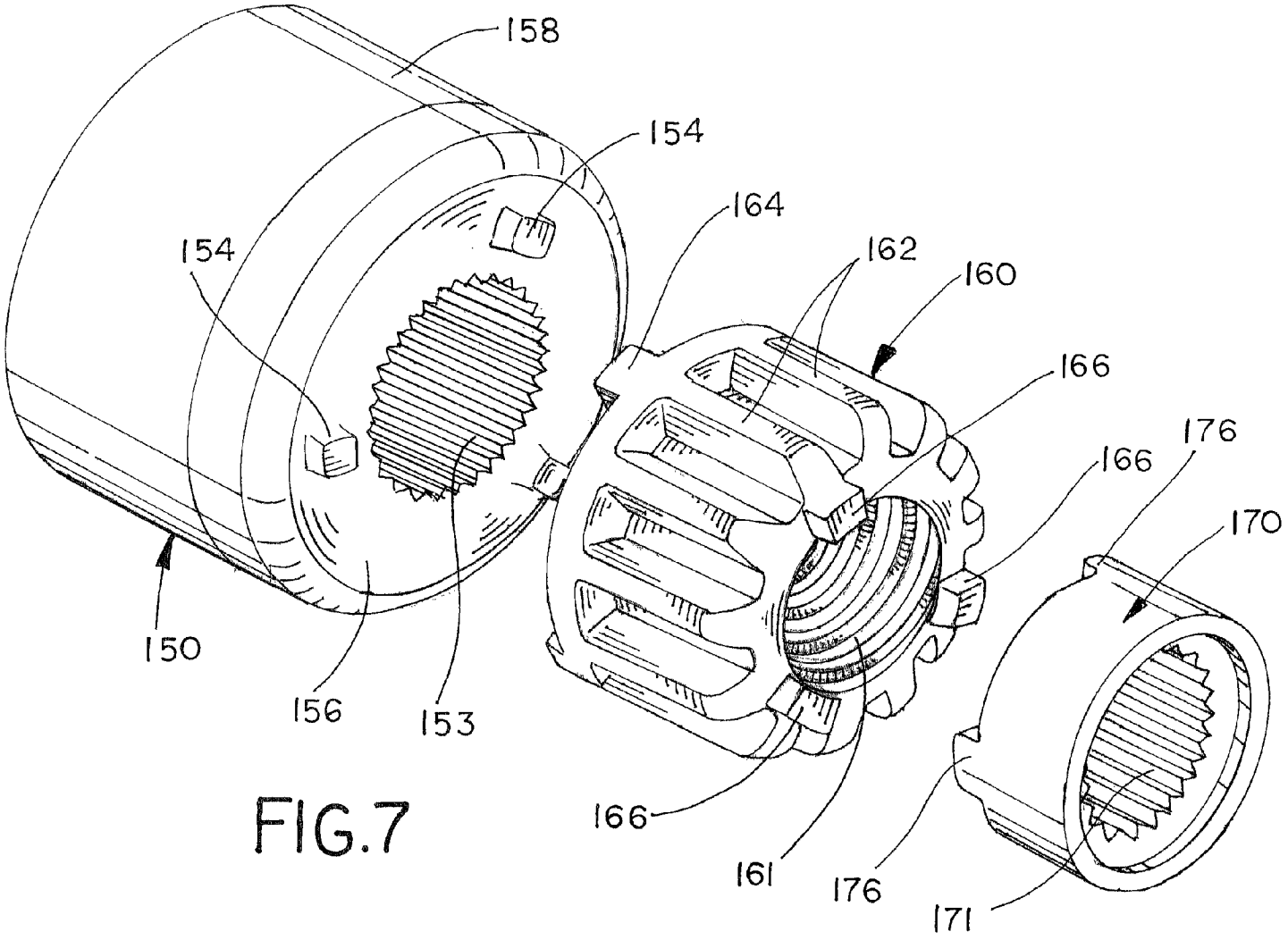
FIG. 7 is a partial exploded view of the clutch housing, pinion and stop nut used in the inertia drive of FIG. 1.
Figure 8:
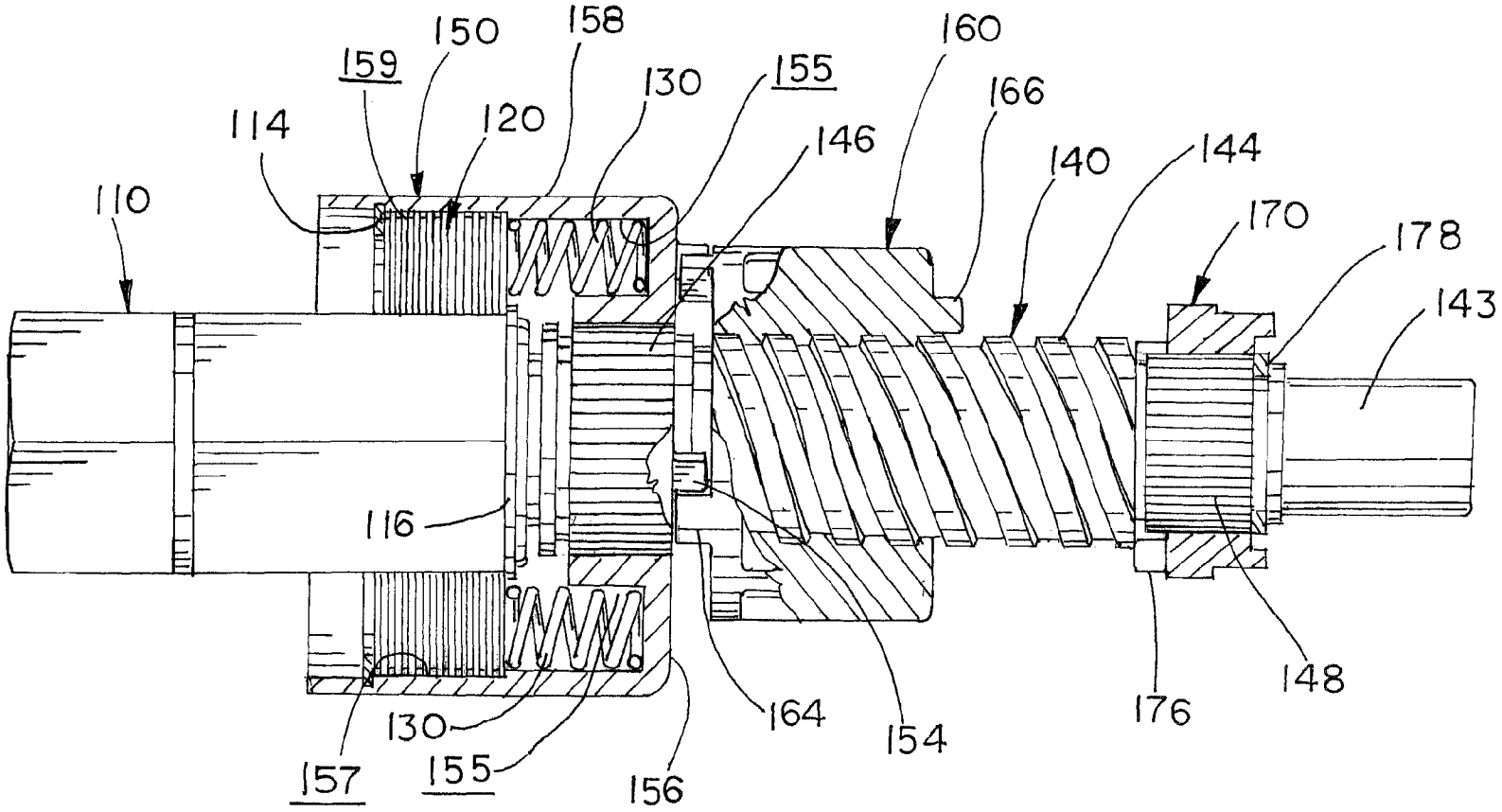
FIG. 8 is a partial side sectional view of the inertia drive of FIG. 1 showing the pinion in the "pre-start" or "neutral" position.
Figure 9:
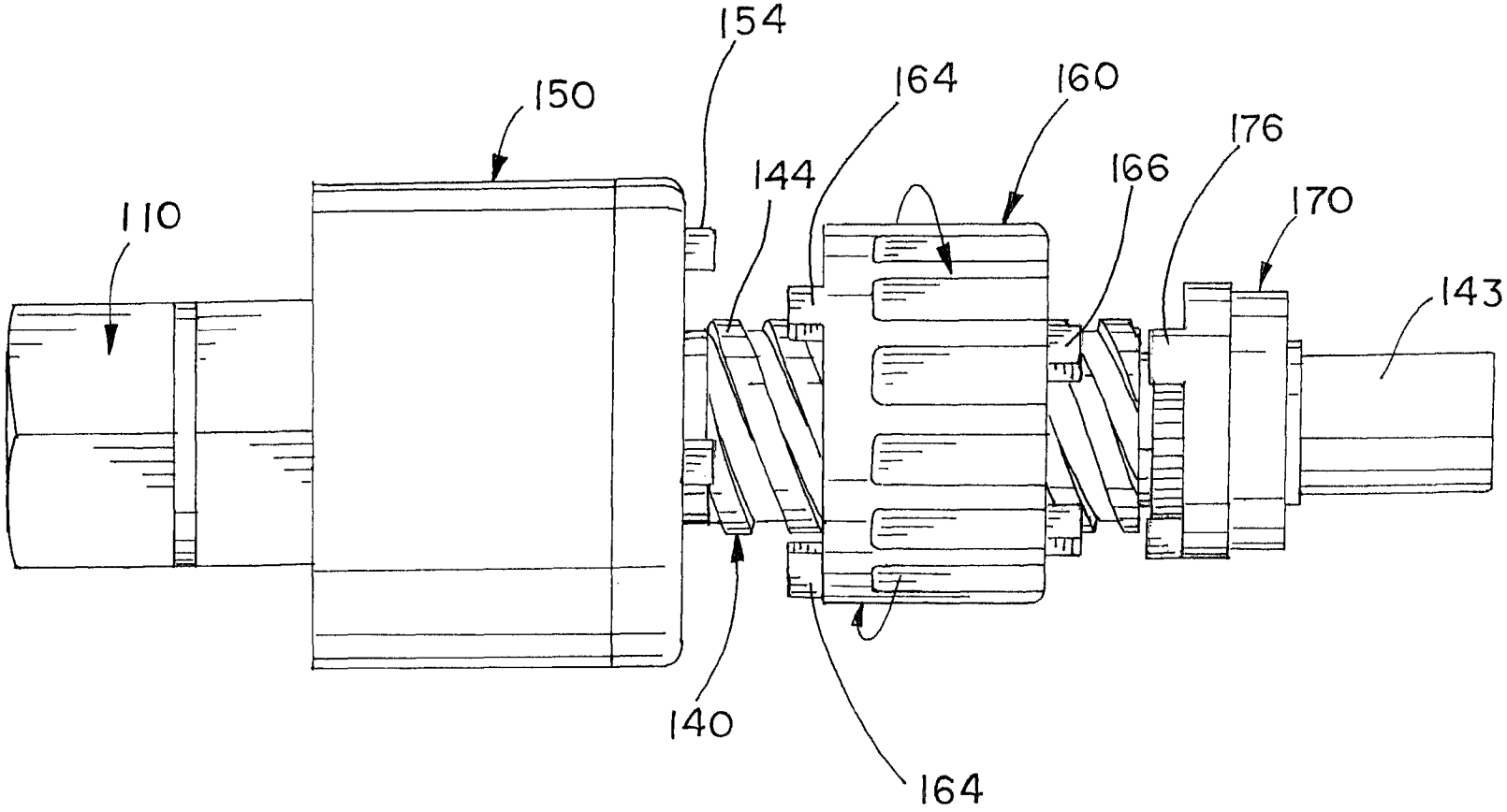
FIG. 9 is a side view of the inertia drive of FIG. 1 showing the pinion traversing between the "pre-start" and "start" positions.

The shaft/pinion subassembly includes a screw shaft 140, pinion 160 and stop nut 170. Typically, screw shaft 140 is machined, rolled and or otherwise formed from a length of standard metal bar stock. One end 141 of screw shaft 140 is adapted to couple to input head shaft 110. The other end 143 of screw shaft 140 is adapted to couple to the drive shaft of the combustion engine. As shown in FIG. 6, the middle section of screw shaft 140 has an acme thread 144, which is preferably roll cut into the bar stock. Screw shaft 140 also has two machined or formed splined sections or splined heads 146 and 148 on opposite ends of acme thread 144. Spline head 146 has a larger outer diameter than spline head 148, and is configured to mesh within splined opening 153 of clutch housing 150. With the shaft/pinion subassembly coupled to the clutch subassembly, screw shaft 140 extends from clutch housing 150 with splined head 146 restrictively seated within splined opening 153. The input end 141 of screw shaft 140 is journalled within a bushing seated within input head shaft 110. A raised shoulder 145 formed in screw shaft 140 prevents screw shaft 100 from being uncoupled from the clutch subassembly. As shown in FIG. 8, shoulder 145 is juxtaposed between the end of the input head shaft 110 and the bottom wall 156 of clutch housing 150 giving the screw shaft some axial play with respect to the clutch subassembly.

Pinion 160 and stop nut 170 are typically investment cast components. Pinion 160 has an acme threaded axial bore 161. Pinion 160 is rotatably carried on screw shaft 140 and is free to traverse the length of acme threads 144. A set of three contact nubs 164 extend integrally from one end of pinion 160 around the axial bore 161. Another set of contact nubs 166 extend from the other end of pinion 160 around axial bore 161. Stop nut 170 is cast, machined or otherwise formed to have a splined axial bore 171 configured to mate with splined head 148 of screw shaft 140. Stop nut 170 is secured to screw shaft 140 by a snap ring 178 that seats within an annular groove 149 formed in the screw shafted adjacent splined head 148. Stop nut 170 also has a set of three contact nubs 176 extending radially around splined bore 171.

Figure 10:
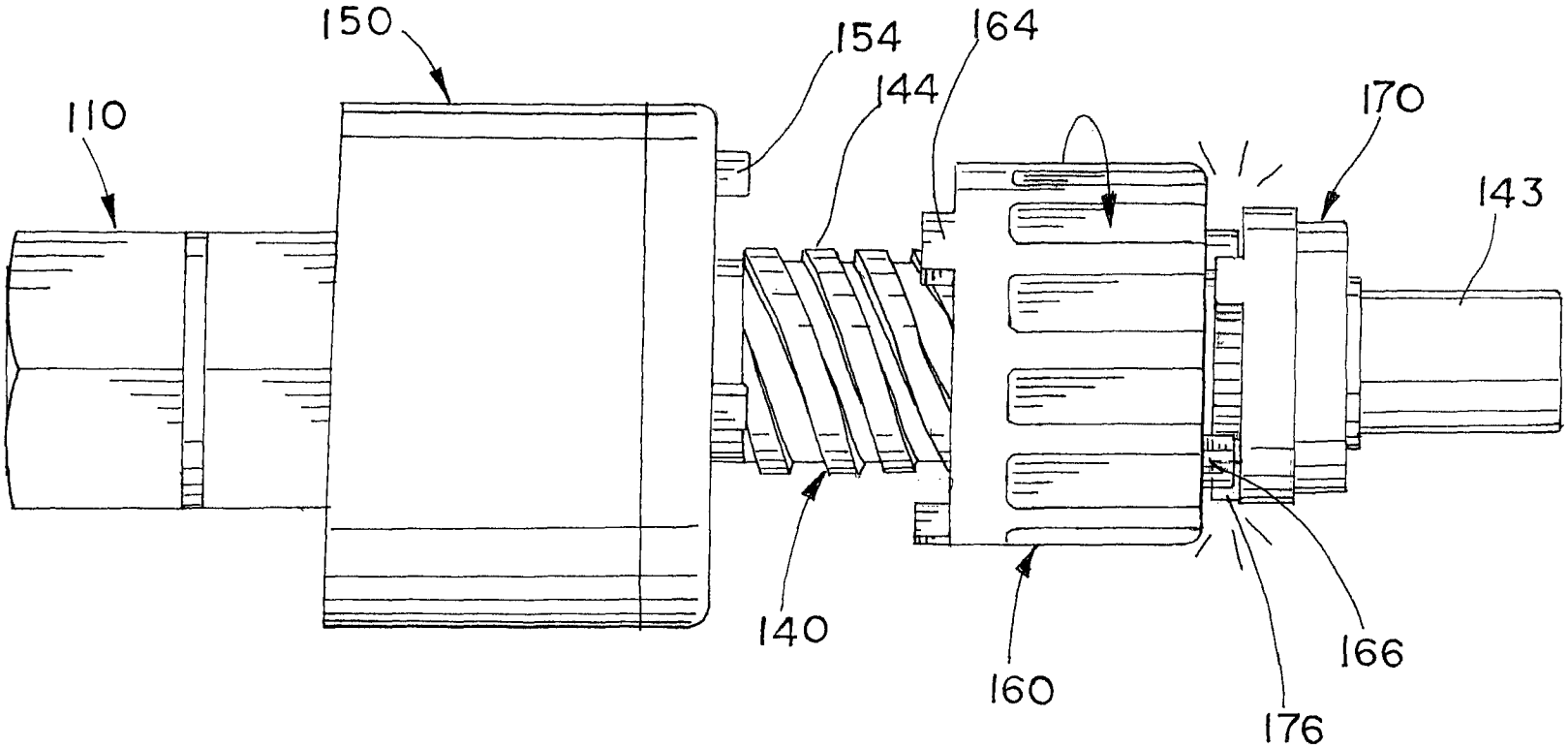
FIG. 10 is a side view of the inertia drive of FIG. 1 showing the pinion in the "start" position.
Figure 12:
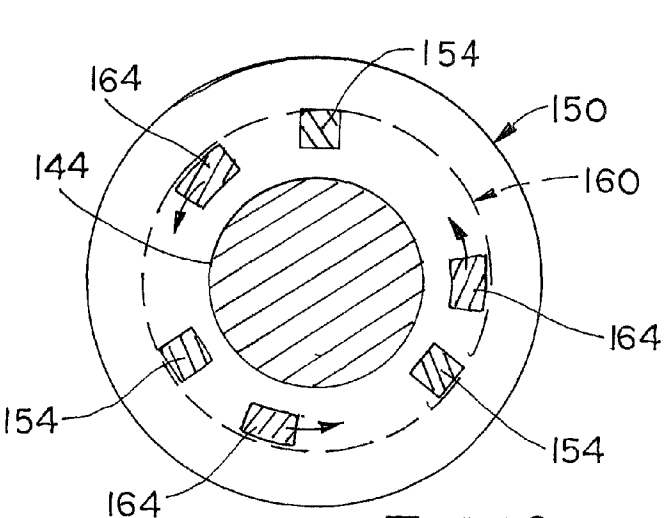
FIG. 12 is an end section view of the inertia drive of FIG. 1 taken along line BB.

In operation, inertia drive 100 begins in the "pre-start" or "neutral" position (FIGS. 8 and 11) where the pinion 160 is rotated along acme thread 144 to couple with clutch housing 150. The sides of contact nubs 164 of pinion 160 abut radially against the sides of contact nubs 154 of clutch housing 150 when the inertia drive is in the pre-start (neutral) position. It should be noted that screw shaft 140, clutch housing 150 and pinion 160 are configured so that the clutch house housing and pinion do not come into "face to face" contact with each other. Rather, the only physical contact between clutch housing 150 and pinion 160 when the pinion is engaged with the clutch housing in the "pre-start" position is between the sides of the abutting contact nubs 154 and 164. Initially, slippage in clutch stack 120 allows the starting break away torque from the starter motor turning the input head shaft 110 to be gradually transferred to pinion 160 via clutch housing 150. As the clutch housing and pinion begin to rotate, centrifugal force spins pinion 160 away from clutch housing 150 towards stop nut 170 and the "start or driven" position of the inertia drives (FIGS. 10 and 12). In the "start" position, pinion 160 engages stop nut 170, transferring torque from the input head shaft 110 to the screw shaft 140. The sides of contact nubs 166 of pinion 160 abut radially against the sides of contact nubs 176 of stop nut 170 when the inertia drive is in the "start" position. Again, the only physical contact between the clutch housing and pinion when the pinion is engaged with the stop nut in the "pre-start" position is between the sidewalls of the abutting contact nubs 166 and 176.

Figure 11:
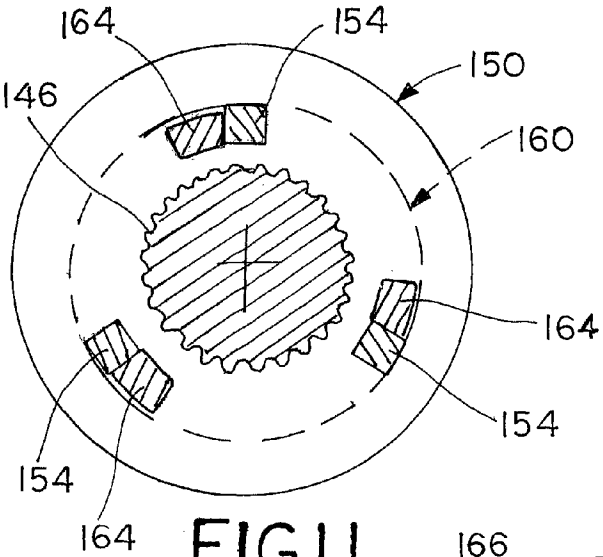
FIG. 11 is an end section view of the inertia drive of FIG. 1 taken along line AA.
Figure 13:
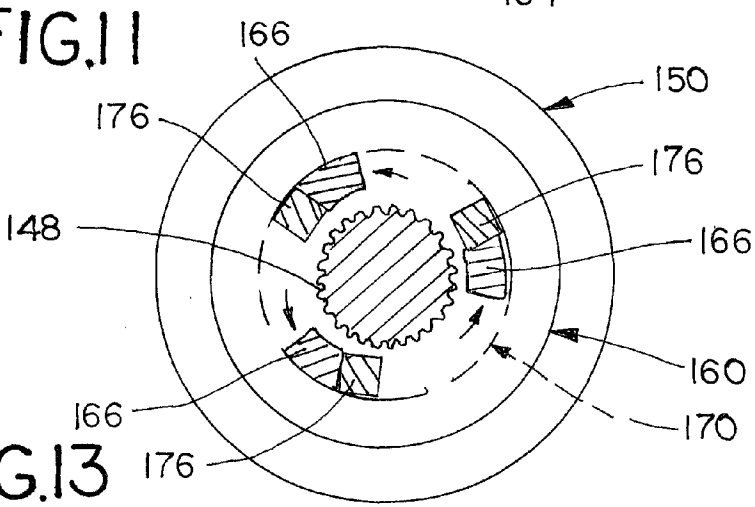
FIG. 13 is an end section view of the inertia drive of FIG. 1 taken along line CC.

The use of splined coupling between the clutch housing, screw shaft and stop nuts allows the orientation of pinion 160 to the clutch housing 150 and stop nut 170 to be incrementally adjusted. As depicted in FIGS. 11 and 13, the splined coupling between clutch housing 150 and screw shaft 140 allows the clutch housing to be selectively oriented to the screw shaft so that contact nubs 164 of pinion 160 properly align and abut against contact nubs 154 of clutch housing 150 when the pinion is in the "pre-start" position. Similarly, the splined coupling between the stop nut 170 and screw shaft 140 allows the stop nut 170 to be selectively oriented on screw shaft 140 so that contact nubs 176 of stop nut 170 properly align and abut against contact nubs 166 of pinion 160 when the pinion is in the "start" position. The ability to selectively orientate clutch housing 150 and stop nut 170 on the screw shaft relative to the position of the pinion 160 allows inertia drive 100 to be mechanically adjusted to ensure that pinion 140 does not come into "face-to-face" contact with either clutch housing 150 or stop nut 170, and that the only physical contact between the pinion, clutch housing and stop nut is between the sides of the abutting contact nubs. In addition, the ability to selectively adjust the orientation of clutch housing 150 and stop nut 170 on screw shaft 140 eliminates the need for acme threads 144 of screw shaft 140 to be precisely aligned and oriented in order to ensure that the pinion properly engages both the clutch housing and the stop nut. Since only one contact nub of the clutch housing 150 or stop nut 170 needs to engage a single contact nub of pinion 160 in the operation of inertia drive 100, minor manufacturing defects and tolerance variations in either screw shaft 140, clutch housing 150, pinion 160 or stop nut 170 may be accounted and compensated for by selectively adjusting the orientation of either splined coupling.

Figure 14:
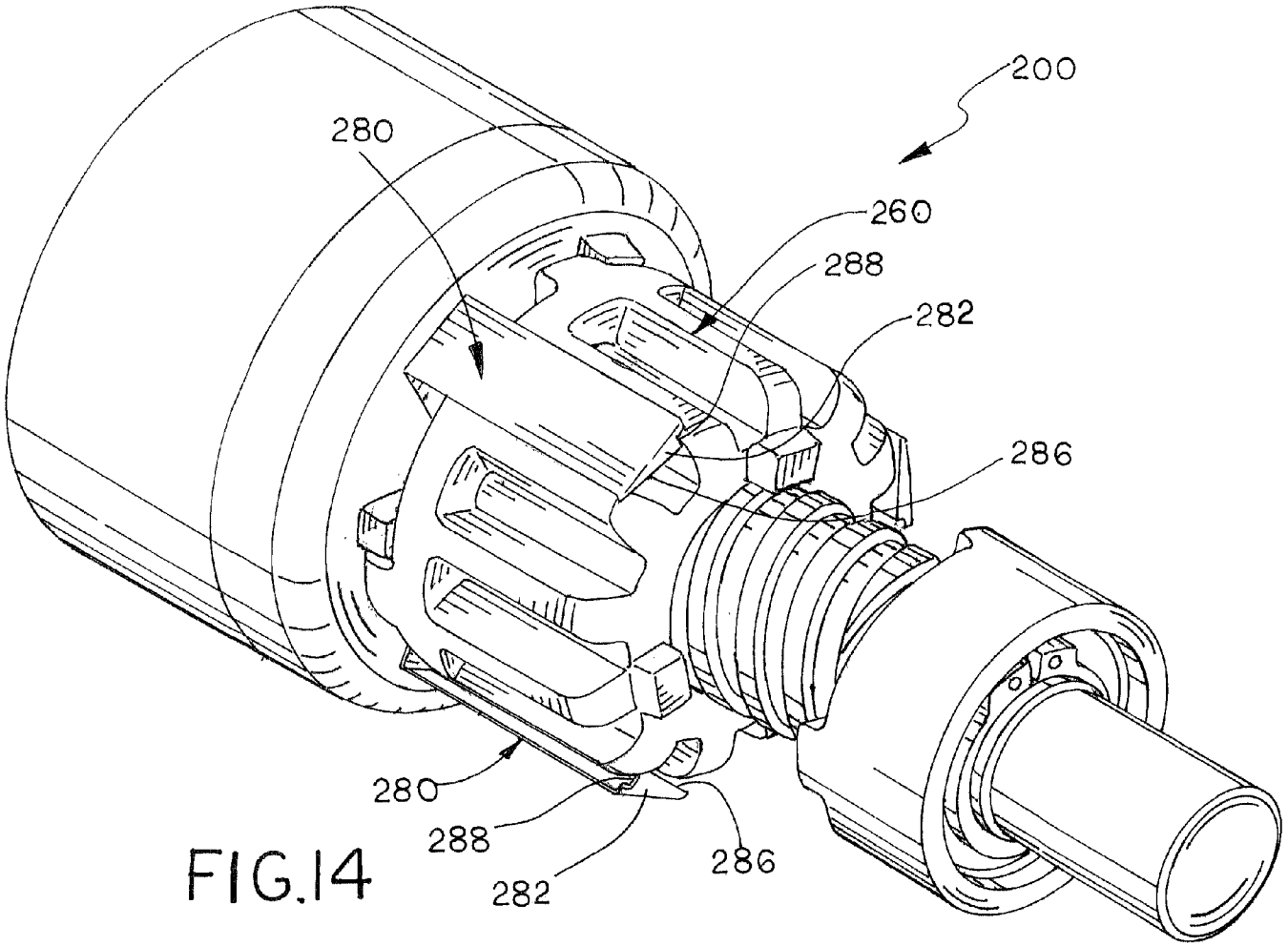
FIG. 14 is a perspective view of a second embodiment of the inertia drive of this invention showing the pinion in the "pre-start"* position.
Figure 15:
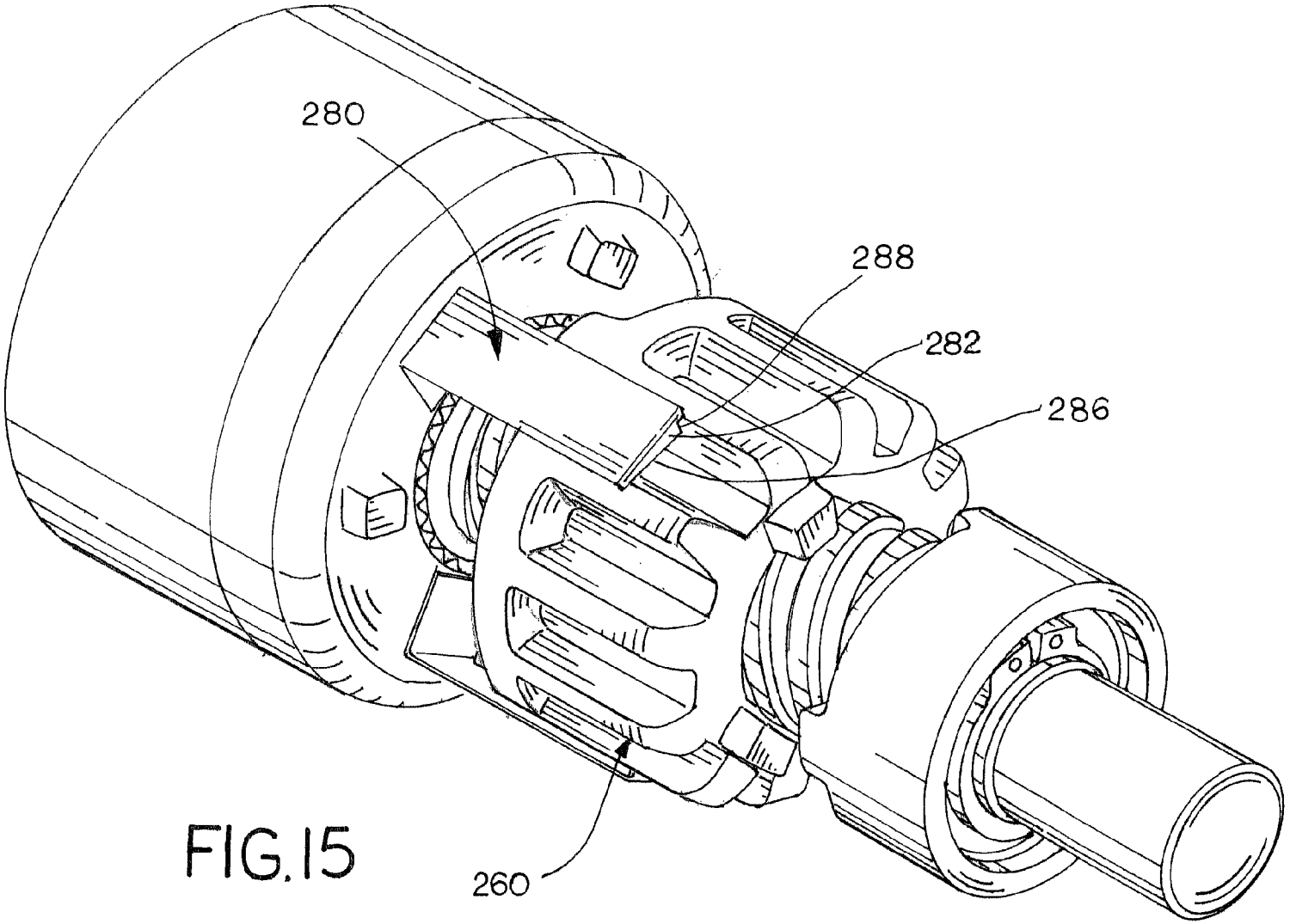
FIG. 15 is a perspective view of a second embodiment of the inertia drive of this invention showing the pinion traversing between the "pre-start" and "start" positions.
Figure 16:
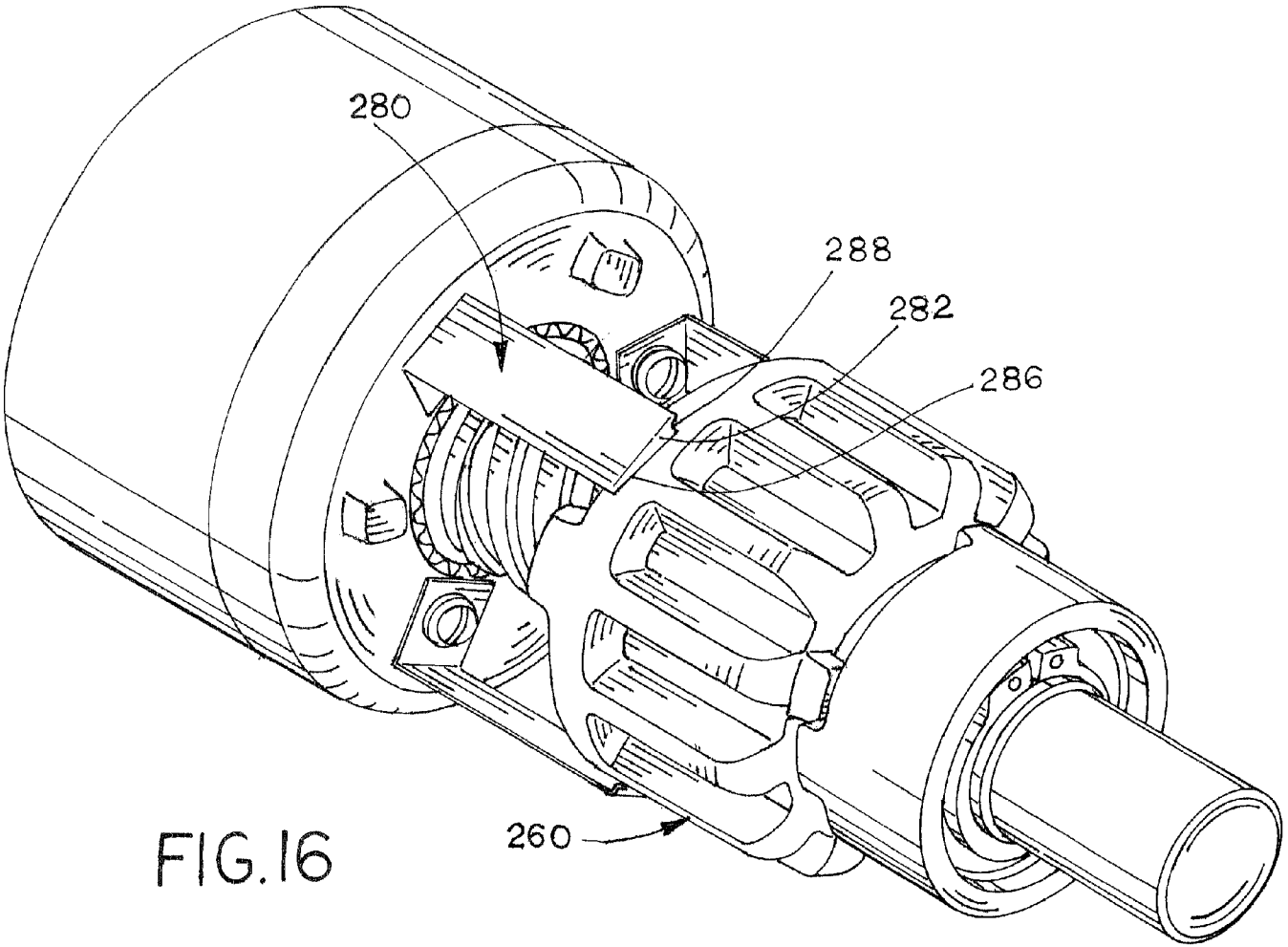
FIG. 16 is a perspective view of a second embodiment of the inertia drive of this invention showing the pinion in the "start" position.

FIGS. 14-15 illustrate a second embodiment of the inertia drive of this invention, which is designated generally as reference numeral 200. Inertia drive 200 is identical in form and structure as inertia drive 100 of FIGS. 1-13, except that it includes three L-shaped cantilevered bar springs 280 that operatively engage the teeth of pinion 260 to provide an opposing force to the torque load on the pinion as it traverses between the "pre-start" position and the start position. Springs 280 are fastened to the bottom of the clutch housing and extend longitudinally over pinion 260. Each spring 280 has a down-turned distal end 282 that seats between adjacent teeth of pinion 260. Each distal end 282 has an angled bottom edge 286 and angled shoulder 288. The angled orientation of bottom edge 286 and the contour of shoulder 288 allows distal end 282 to nest between adjacent pinion teeth when pinion 260 is the pre-start position (FIG. 14). As pinion 260 rotates and traverse across the screw shaft from the "pre-start" position to the "start" position (FIG. 16), springs 280 splay outward under tension. Again, the angled orientation of bottom edge 286 and the contour of shoulder 288, allow distal end 282 to unseat from and ride over adjacent pinion teeth. The radial spring force provided by springs 280 on pinion 260 acts against the break out torque load of inertia drive 200. Consequently, springs 280 can be used to selectively control the impact forces on pinion 260 for particular operational parameters. Because springs 280 are simply fastened to the clutch housing, springs can be readily swapped for other leaf springs with different spring tensions to selectively adjust the counterbalancing torque load.

One skilled in the art will note that the inertia drives embodying this invention present certain mechanical improvement over the conventional engine starter drives and simplify the design and manufacture while increasing the durability of the inertia drives. The present invention reduces the number of parts and components and replaces expensive highly machined components with less expensive, more durable components. As a result, the inertia drives embodying this invention provide a more versatile mechanism that can operate across a wide range of large displacement engines while reducing the overall cost of the drives.

In the present invention, the use of the splined engagement and snap rings eliminates the need for stop nuts to be threaded onto the screw shaft, reducing manufacturing cost and increasing durability. The use of a splined engagement also eliminates the need for the acme thread of the screw shaft to be precisely oriented and machined on the screw shaft. Consequently, the acme threads can be manufactured using less expensive manufacturing methods, such as roll forming. The use of hexagonal bar stock in fashioning the input head shaft reduces manufacturing costs and provides a more positive engagement with the clutch stack. The present invention also eliminates the need for additional springs or other associated components and structures, which conventional inertia drive rely on to control the torque and impact force placed on the drives during use.

The inertia drives of this invention use contact nubs formed on the clutch housing, pinion and stop nut to radially transfer the load without "face-to-face" contact. In conventional inertia drives, torque is transferred by "face to face" contact between the pinion and the stop nut. As the pinion "spins out" to engage the stop nut and drive the engine flywheel, the screw shaft continues to rotate. As the resistance load for turning the engine flywheel increases, the axial load of the pinion against the stop nut is increased by the "wedge effect" of the acme threads on the screw shaft. The thread angle of the acme threads creates a mechanical advantage that results in a force multiplier that significantly increases the axial load on the stop nut. Conventional inertia drives often have catastrophic mechanical failures where stop nuts are blown off of screw shafts trying to retain the pinion under high resistance loads. In the inertia drives of this invention, load is transferred radially through the "side-by-side" abutting engagement of contact nubs without "face-to-face" contact between the pinion and stop nut. The use of contact nubs for radially transferring torque in this invention eliminates the axial load multiplier. Consequently, the inertia drive of this invention can withstand higher starting loads, and absorb impact shock while not affecting the load transfer.

The use of splined engagements for coupling the clutch housing and the stop nut to the screw shaft allows both the clutch housing and stop nuts to be selectively oriented on the screw shaft with incremental adjustability to properly align the pinion relative to both the clutch housing and the stop nut. In conventional inertia drives, the radial orientation between the pinion, clutch head and stop nut are fixed by the orientation of the acme threads formed on the screw shaft. In the present invention, the ability to selectively orient the clutch housing and stop nut to the screw shaft allows the inertia drive to be mechanically adjusted to ensure that the pinion does not come into "face-to-face" contact with either the clutch housing or the stop nut, and that the only physical contact between the pinion, clutch housing and stop nut is between the sides of the abutting contact nubs.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. An inertia drive for transferring torque from a starter motor to a combustion engine comprising:

an elongated screw shaft having an input end and an output end adapted for connection to the engine;

an input head shaft having a first end thereof adapted to connect to a starter motor and a second end thereof adapted to rotatably receive the input end of the screw shaft;

a clutch housing coupled to the screw shaft;

a stop nut coupled to the screw shaft;

a pinion rotatably carried by the screw shaft for traverse movement between a first position abutting the clutch housing and a second position abutting the stop nut;

a clutch plate stack accommodated on the input head shaft and contained within a clutch body; and a clutch spring disposed within the clutch housing in compressive engagement with the clutch stack, the clutch housing is selectively coupled to the screw shaft so that the pinion contacts the clutch housing at selected radial orientation when the pinion is in the first position.

2. The inertia drive of claim 1 wherein the screw shaft has a first splined head, the clutch housing has a splined axial opening therein, the first splined head of the screw shaft seated within the splined axial opening of the clutch housing to operatively couple the clutch housing to the screw shaft.

3. The inertia drive of claim 2 wherein the first splined head is formed in the screw shaft adjacent the input end of the screw shaft.

4. The inertia drive of claim 2 wherein the stop nut is coupled to the screw shaft for selectively orientating the stop nut on the screw shaft to radially orientate the stop nut in relation to the pinion when the pinion is in the second position.

5. The inertia drive of claim 4 wherein the screw shaft has a second splined head formed adjacent the input end of the screw shaft, the clutch housing has a splined axial opening therein, the second splined head of the screw shaft seated within the splined axial opening of the clutch housing to operatively couple the clutch housing to the screw shaft.

6. The inertia drive of claim 5 wherein the second splined head is formed in the screw shaft adjacent the output end of the screw shaft.

7. The inertia drive of claim 6 wherein the pinion traverses along the screw shaft between the first splined head and the second splined head.

8. The inertia drive of claim 1 wherein the input head shaft has a hexagonal cross section, clutch stack includes a plurality of alternating input plates and output plates, one of the input plates and output plates each have hexagonal central opening for receiving the input head shaft therethrough in driving engagement, the other of the input plates and output plates each have circular central openings for receiving the input head shaft therethrough.

9. The inertia drive of claim 1 and a cantilevered bar spring mounted to the clutch housing to extend over the pinion and apply radial compressive force against the pinion.

10. The inertia drive of claim 9 wherein the pinion includes a plurality of radially extending teeth, the bar spring having a distal end adapted to seat between adjacent teeth when the pinion is in the first position and ride over the teeth as the pinion moves between the first position and second position.

11. The inertia drive of claim 1 wherein the clutch housing includes a contact nub, the pinion includes contact nub adapted for side-by-side abutting engagement with the contact nub of the clutch housing when the pinion is in the first position.

12. The inertia drive of claim 11 wherein the stop nut includes a contact nub, the pinion includes a second contact nub adapted for side-byside" abutting engagement with the contact nub of the stop nut when the pinion is in the second position.

13. An inertia drive for transferring torque from a starter motor to a combustion engine comprising:

an elongated screw shaft having an input end and an output end adapted for connection to the engine;

an input head shaft having a first end thereof adapted to connection to a starter motor and a second end thereof adapted to rotatably receive the input end of the screw shaft;

a clutch housing coupled to the screw shaft;

a stop nut coupled to the screw shaft;

a pinion rotatably carried by the screw shaft for traverse movement between a first position abutting the clutch housing and a second position abutting the stop nut;

a clutch plate stack accommodated on the input head shaft and contained within a clutch body; and a clutch spring disposed within the clutch housing in compressive engagement with the clutch stack, the stop nut is coupled to the screw shaft for selectively orientating the stop nut on the screw shaft to radially orientate the stop nut in relation to the pinion when the pinion is in the second position.

14. The inertia drive of claim 13 wherein the screw shaft has a second splined head formed adjacent the input end of the screw shaft, the clutch housing has a splined axial opening therein, the second splined head of the screw shaft seated within the splined axial opening of the clutch housing to operatively couple the clutch housing to the screw shaft.

15. The inertia drive of claim 13 wherein the input head shaft has a hexagonal cross section, clutch stack including a plurality of alternating input plates and output plates, one of the input plates and output plates each have hexagonal central openings for receiving the input head shaft therethrough in driving engagement, the other of the input plates and output plates each have circular central openings for receiving the input head shaft therethrough.

16. The inertia drive of claim 13 and a cantilevered bar spring mounted to the clutch housing to extend over the pinion and apply radial compressive force against the pinion.

17. The inertia drive of claim 16 wherein the pinion includes a plurality of radially extending teeth, the bar spring having a distal end adapted to seat between adjacent teeth when the pinion is in the first position and ride over the teeth as the pinion moves between the first position and second position.

18. The inertia drive of claim 13 wherein the clutch housing includes a contact nub, the pinion includes contact nub adapted for side-by-side abutting engagement with the contact nub of the clutch housing when the pinion is in the first position.

19. The inertia drive of claim 13 wherein the stop nut includes a contact nub, the pinion includes a second contact nub adapted for side-byside abutting engagement with the contact nub of the stop nut when the pinion is in the second position.

20. An inertia drive for transferring torque from a starter motor to a combustion engine comprising:

an elongated screw shaft having an input end and an output end adapted for connection to the engine;

an input head shaft having a first end thereof adapted to connect to a starter motor and a second end thereof adapted to rotatably receive the input end of the screw shaft;

a clutch housing coupled to the screw shaft;

a stop nut coupled to the screw shaft;

a pinion rotatably carried by the screw shaft for traverse movement between a first position abutting the clutch housing and a second position abutting the stop nut;

a clutch plate stack accommodated on the input head shaft and contained within a clutch body; and a clutch spring disposed within the clutch housing in compressive engagement with the clutch stack, the clutch housing includes a contact nub, the pinion includes a contact nub adapted for side-by-side abutting engagement with the contact nub of the clutch housing when the pinion is in the first position.

21. The inertia drive of claim 20 wherein the stop nut includes a contact nub, the pinion includes a second contact nub adapted for side-by-side" abutting engagement with the contact nub of the stop nut when the pinion is in the second position.

22. The inertia drive of claim 20 wherein the input head shaft has a hexagonal cross section, the clutch stack includes a plurality of alternating input plates and output plates, one of the input plates and output plates each have hexagonal central opening for receiving the input head shaft therethrough in driving engagement, the other of the input plates and output plates each have circular central openings for receiving the input head shaft therethrough.

23. The inertia drive of claim 20 and a cantilevered bar spring mounted to the clutch housing to extend over the pinion and apply radial compressive force against the pinion.

24. The inertia drive of claim 23 wherein the pinion includes a plurality of radially extending teeth, the bar spring having a distal end adapted to seat between adjacent teeth when the pinion is in the first position and ride over the teeth as the pinion moves between the first position and second position.

25. An inertia drive for transferring torque from a starter motor to a combustion engine comprising:

an elongated screw shaft having an input end and an output end adapted for connection to the engine;

an input head shaft having a first end thereof adapted to connection to a starter motor and a second end thereof adapted to rotatably receive the input end of the screw shaft;

a clutch housing coupled to the screw shaft;

a stop nut coupled to the screw shaft;

a pinion rotatably carried by the screw shaft for traverse movement between a first position abutting the clutch housing and a second position abutting the stop nut;

a clutch plate stack accommodated on the input head shaft and contained within a clutch body;

a clutch spring disposed within the clutch housing in compressive engagement with the clutch stack; and a cantilevered bar spring mounted to the clutch housing to extend over the pinion and apply radial compressive force against the pinion.

26. The inertia drive of claim 25 wherein the pinion includes a plurality of radially extending teeth, the bar spring having a distal end adapted to seat between adjacent teeth when the pinion is in the first position and ride over the teeth as the pinion moves between the first position and second position.

27. An inertia drive for transferring torque from a starter motor to a combustion engine comprising:

an elongated screw shaft having an input end and an output end adapted for connection to the engine;

an input head shaft having a first end thereof adapted to connection to a starter motor and a second end thereof adapted to rotatably receive the input end of the screw shaft;

a clutch housing coupled to the screw shaft;

a stop nut coupled to the screw shaft;

a pinion rotatably carried by the screw shaft for traverse movement between a first position abutting the clutch housing and a second position abutting the stop nut;

a clutch plate stack accommodated on the input head shaft and contained within a clutch body;

a clutch spring disposed within the clutch housing in compressive engagement with the clutch stack, the input head shaft has a hexagonal cross section, the clutch stack includes a plurality of alternating input plates and output plates, one of the input plates and output plates each have hexagonal central opening for receiving the input head shaft therethrough in driving engagement, the other of the input plates and output plates each have circular central openings for receiving the input head shaft therethrough.

28. An inertia drive for transferring torque from a starter motor to a combustion engine comprising:

an elongated screw shaft having an input end and an output end adapted for connection to the engine, the screw shaft has a first splined head located adjacent the input end of the screw shaft and a second splined head located adjacent the output end of the screw shaft;

an input head shaft having a first end thereof adapted to connect to a starter motor and a second end thereof adapted to rotatably receive the input end of the screw shaft, the input head shaft has a hexagonal cross section;

a clutch housing coupled to the screw shaft, the clutch housing has a splined axial opening therein;

a stop nut coupled to the screw shaft, the stop nut has a splined axial opening therein;

a pinion rotatably carried by the screw shaft for traverse movement along the screw shaft between the first splined head and the second splined head and between a first position abutting the clutch housing and a second position abutting the stop nut;

a clutch plate stack accommodated on the input head shaft and contained within a clutch body, the clutch stack includes a plurality of alternating input plates and output plates, one of the input plates and output plates each have hexagonal central openings for receiving the input head shaft therethrough in driving engagement, the other of the input plates and output plates each have circular central openings for receiving the input head shaft therethrough;

a clutch spring disposed within the clutch housing in compressive engagement with the clutch stack; and a cantilevered bar spring mounted to the clutch housing to extend over the pinion and apply radial compressive force against the pinion, the pinion includes a plurality of radially extending teeth, the bar spring having a distal end adapted to seat between adjacent teeth when the pinion is in the first position and ride over the teeth as the pinion moves between the first position and second position, the clutch housing includes a contact nub, the stop nut includes a contact nub, the pinion includes a first contact nub adapted for side-by-side abutting engagement with the contact nub of the clutch housing when the pinion is in the first position and a second contact nub adapted for side-byside" abutting engagement with the contact nub of the stop nut when the pinion is in the second position, the clutch housing is operatively coupled to the screw shaft where the first splined head of the screw shaft is selectively seated within the splined axial opening of the clutch housing for selectively orientating the clutch housing on the screw shaft to radially orientate the clutch housing in relation to the pinion when the pinion is in the first position, the stop nut is coupled to the screw shaft where the second splined head of the screw shaft is selectively seated within the splined axial opening of the stop nut for selectively orientating the stop nut on the screw shaft to radially orientate the stop nut in relation to the pinion when the pinion is in the second position.

* * * * *